US006808408B2

(12) United States Patent
Jiang

(10) Patent No.: US 6,808,408 B2
(45) Date of Patent: Oct. 26, 2004

(54) ELECTRICAL CONNECTOR WITH GUIDING STRUCTURE FOR POSITIONING CIRCUIT BOARD

(75) Inventor: Shichao Jiang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/301,325

(22) Filed: Nov. 20, 2002

(65) Prior Publication Data

US 2004/0009698 A1 Jan. 15, 2004

(30) Foreign Application Priority Data

Jul. 10, 2002 (TW) ..... 91210505 U

(51) Int. Cl.[7] ..... H01R 13/64; H01R 13/62

(52) U.S. Cl. ..... 439/377; 439/157; 439/160; 361/786

(58) Field of Search ..... 439/374, 377, 439/157–160; 361/786

(56) References Cited

U.S. PATENT DOCUMENTS 5,145,397 A * 9/1992 Yamada et al. ..... 439/328
5,511,985 A * 4/1996 Noschese et al. ..... 439/157
5,690,499 A * 11/1997 Howell et al. ..... 439/157
5,781,414 A * 7/1998 Mills et al. ..... 361/786
6,012,952 A * 1/2000 Choy et al. ..... 439/637
6,305,966 B1 * 10/2001 Arbogast et al. ..... 439/377
6,431,890 B1 * 8/2002 Li et al. ..... 439/160

* cited by examiner

*Primary Examiner*—Michael C. Zarroli
(74) *Attorney, Agent, or Firm*—Wei Te Chung

(57) ABSTRACT

An electrical connector (1) for receiving a circuit board (2) includes an elongated insulative housing (10) defining a longitudinal slot (11) for receiving the circuit board. A multiplicity of evenly-spaced passageways (12) is defined in two sidewalls (13) of the housing that are at opposite sides of the slot respectively. A multiplicity of conductive terminals (14) is received in the passageways, for electrically connecting the circuit board. A pair of guiding arms (130) extends upwardly from opposite ends of the housing respectively. Each arm defines a central guiding channel (131), for guiding the circuit board into the slot. The central guiding channel has a width narrower than that of the slot, thereby the circuit board can securely be received in the slot.

8 Claims, 4 Drawing Sheets

ELECTRICAL CONNECTOR WITH GUIDING STRUCTURE FOR POSITIONING CIRCUIT BOARD

BACKGROUND OF THE INVENTION

1. Field of the Invention

The present invention relates to an electrical connector for receiving a circuit board therein, and particularly to an electrical connector with guiding structures for positioning the circuit board therein.

2. Description of Related Art

There have been many developments and innovations of electrical connectors that receiving circuit boards and make electrical connection therebetween. Electrical connectors known as card edge connectors have been widely used for some time now. A typical card edge connector is described in "Properties of Card Edge Connector Spring/Tab Interface" (P460~466, May 28, 2002). Other card edge connectors are disclosed in U.S. Pats. Nos. 4,869,672, 5,052,936 and 5,171,154.

Referring to FIG. 3, a conventional card edge connector 9 comprises an elongated insulative housing 90 defining a longitudinal slot 92 therein for receiving a circuit board 8. A multiplicity of evenly-spaced passageways is defined in two sidewalls of the housing 90 that are at opposite sides of the slot 92 respectively. A multiplicity of conductive terminals 91 is received in the corresponding passageways, for electrically connecting with the circuit board 8. The slot 92 is slightly wider than the thickness of the circuit board 8, and only a relatively small portion of the circuit board 8 is received in the slot 92. As a result, the circuit board 8 cannot be securely received in the slot 92. The circuit board 8 is prone to be damaged, especially when the connector 9 is subjected to shock or vibration during normal use. This can result in faulty electrical connection between the circuit board 8 and the card edge connector 9, or even failure of electrical connection.

In view of the above, a new electrical connector that overcomes the above-mentioned disadvantages is desired.

SUMMARY OF THE INVENTION

Accordingly, an object of the present invention is to provide an electrical connector for securely receiving a circuit board therein, so that the circuit board maintains reliable electrical connection with the connector.

To achieve the above-mentioned object, an electrical connector in accordance with a preferred embodiment of the present invention is for receiving a circuit board therein. The connector comprises an elongated insulative housing defining a longitudinal slot therein for receiving the circuit board. A multiplicity of evenly-spaced passageways is defined in two sidewalls of the housing that are at opposite sides of the slot respectively. A multiplicity of conductive terminals is received in the passageways, for electrically connecting with the circuit board. A pair of guiding arms extends upwardly from opposite ends of the housing respectively. Each arm defines a central guiding channel therethrough, for guiding the circuit board into the slot and securely receiving the circuit board therein.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
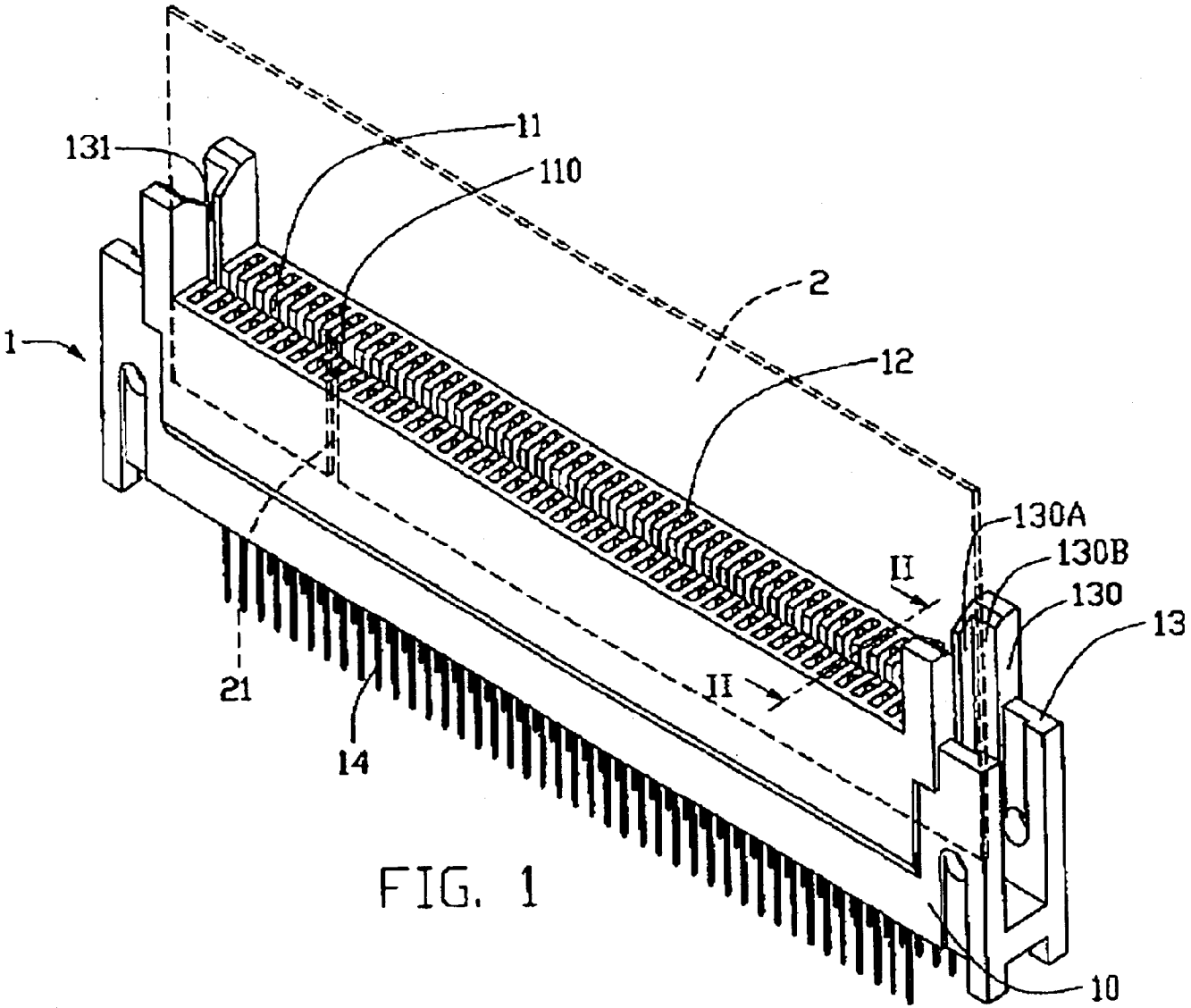
FIG. 1 is an isometric view of an electrical connector in accordance with a preferred embodiment of the present invention, also showing a circuit board in dashed lines received in the electrical connector.
Figure 2:
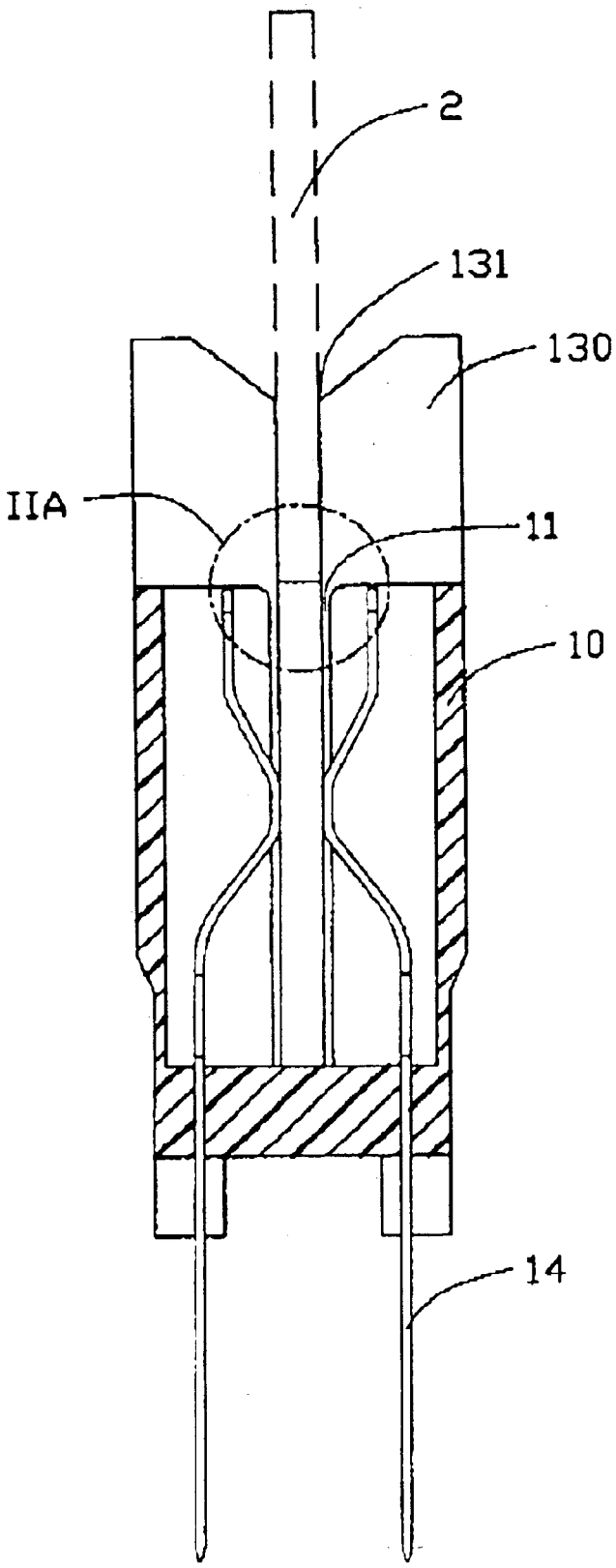
FIG. 2 is an enlarged cross-sectional view taken along line 11—11 of FIG. 1.
Figure 2A:
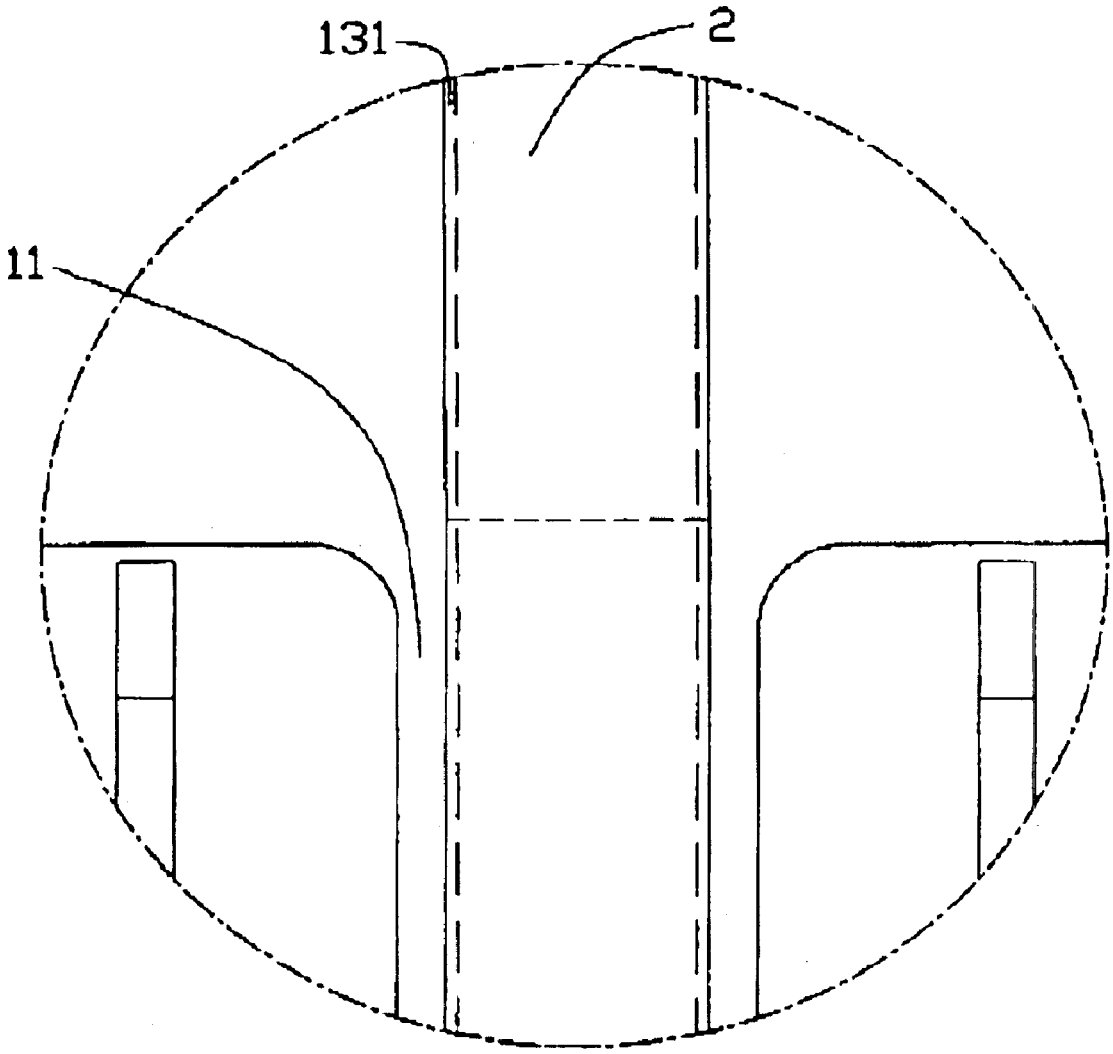
FIG. 2A is an enlarged view of a circled portion IIA of FIG. 2.
Figure 3:
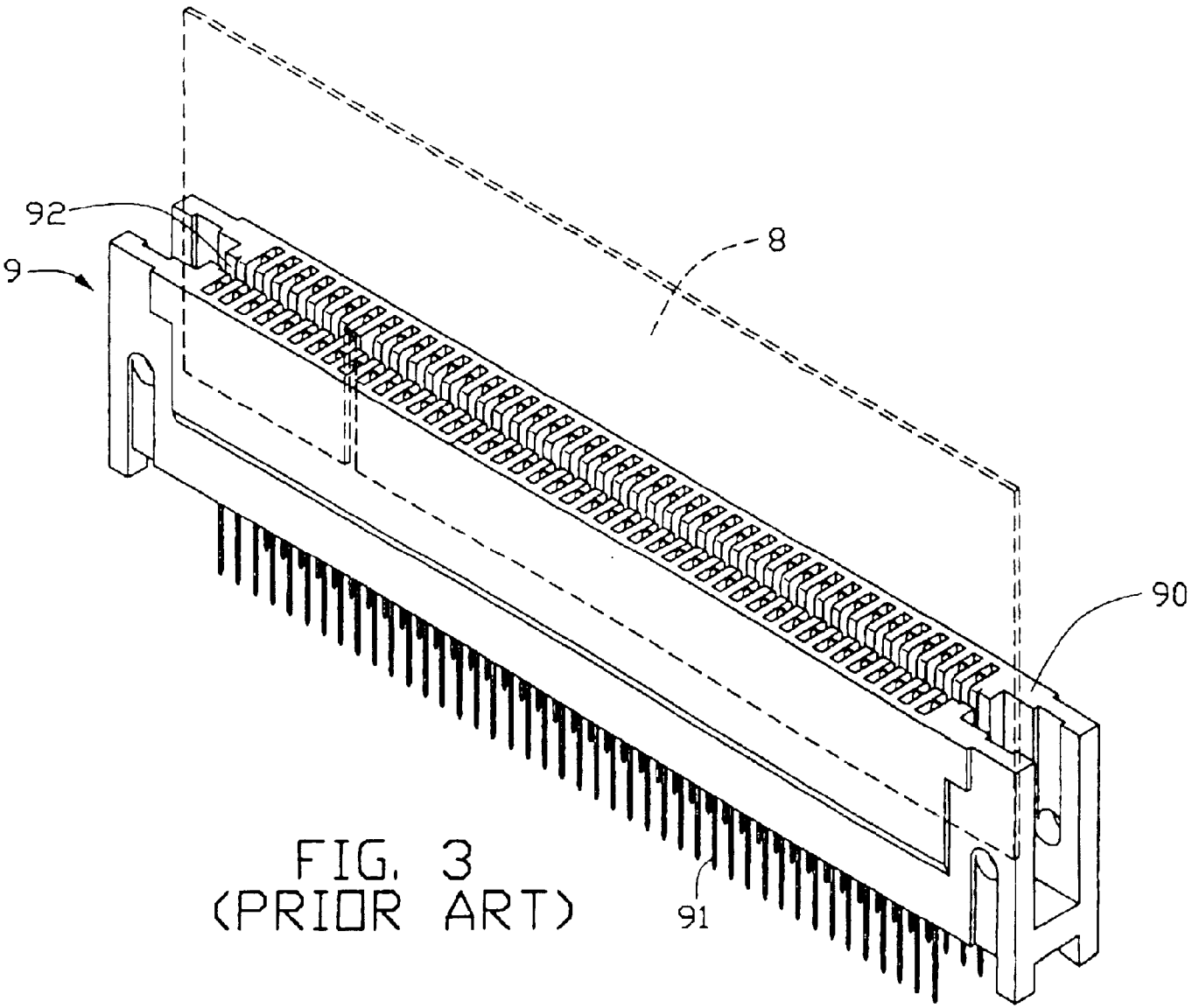
FIG. 3 (PRIOR ART)
FIG. 3 is an isometric view of a conventional electrical connector, also showing a circuit board in dashed lines received in the electrical connector.

Referring to FIGS. 1, 2 and 2A, an electrical connector 1 in according with a preferred embodiment of the present invention comprises an elongated insulative housing 10 defining a longitudinal slot 11 therein for receiving a circuit board 2. A multiplicity of evenly-spaced passageways 12 is defined in two sidewalls 13 of the housing 10 that are at opposite sides of the slot 11 respectively. A multiplicity of conductive terminals 14 is received in the corresponding passageways 12, for electrically connecting with the circuit board 2.

A pair of protrusions 110 is respectively formed on the opposite sidewalls 13 of the housing 10. A cutout 21 is defined in the circuit board 2, for engagingly receiving the protrusions 110 of the housing 10. The protrusions 110 mate in the cutout 21, and provide the connector 1 with blind mating. This ensures that the circuit board 2 is correctly received in the slot 11.

The connector 1 further comprises a pair of guiding arms 130 extending upwardly from opposite ends of the housing 10 respectively. Each guiding arm 130 has two opposite L-shaped cross-sectional pieces each configured with a first vertical section 130A and a second vertical section 130B extending from a lateral edge of the first vertical section 130A, and defines a central guiding channel 131 between two first vertical section 130A of the two pieces. Said guiding channel 131 has a uniform width. Each guiding channel 131 has a V-shaped opening to facilitate insertion of the circuit board 2 thereinto. Furthermore, the uniform width of the guiding channel 131 is slightly wider than a thickness of the circuit board 2 and narrower than a width of the slot 11, so that the circuit board 2 is firmly held in the guiding channels 131 and securely received in the slot 11. This prevents the circuit board 2 from being damaged in the slot 11, especially when the connector 1 is subjected to shock or vibration during normal use. It also ensures that the circuit board 2 maintains reliable electrical connection with the connector 1.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for receiving a circuit board therein, the electrical connector comprising:

an insulative housing defining a longitudinal slot therein, and defining a plurality of passageways in two sidewalls that are at opposite sides of the slot respectively;

a plurality of conductive terminals received in the passageways; and a pair of guiding arms extending upwardly from opposite ends of the housing respectively, each of the arms defining a guiding channel therethrough;

wherein said guiding channel has a width wider than a thickness of the circuit board and narrower than a width of the slot along a transverse direction vertical to a longitudinal direction of the housing, and when the circuit board is inserted in the slot by guidance of the guiding channels, the guiding arms can firmly position the circuit board in the slot;

wherein the width of the channel is uniformly wide along a direction of insertion of the circuit board.

2. The electrical connector as described in claim 1, wherein at least one protrusion is formed in the housing for mating in a corresponding cutout of the circuit board.

3. An electrical connector assembly comprising:

a circuit board; and an electrical connector comprising an insulative housing and a plurality of electrical terminals received in corresponding passageways of the housing;

wherein the housing defines a longitudinal slot therein, a pair of guiding arms extends in a same direction from opposite ends of the housing, and each of the arms defines a guiding channel therethrough whose width along the entire guiding channel length is wider than a thickness of the circuit board and narrower than a width of the slot, whereby the circuit board is guided into the slot by the guiding channels and securely received therein.

4. The electrical connector as claimed in claim 3, wherein each of the guiding channels has a V-shaped opening.

5. The electrical connector as claimed in claim 4, wherein at least one protrusion is formed in the housing for mating in a corresponding cutout of the circuit board.

6. An electrical connector assembly comprising:

a circuit board; and an electrical connector comprising an insulative housing with a central slot and a plurality of electrical terminals disposed by two sides of the slot;

a pair of guiding arms extends upwardly from opposite ends of the housing, and each of the arms defines a guiding channel therethrough which is wider along the entire guiding channel length than a thickness of the circuit board and narrower than a width of the slot;

whereby the circuit board is guided into the slot by the guiding channels and securely received therein; wherein each of said guiding arms is composed of two opposite separate pieces each with an L-shaped cross-sectional configuration composed of a first vertical section and a second vertical section extending substantially perpendicularly from the first vertical section, and the guiding channel is defined between the first vertical sections of said L-shaped configuration of said two opposite pieces.

7. The connector assembly as described in claim 6, wherein the guiding arms are integrally formed with the housing.

8. The connector assembly as described in claim 6, wherein the width of the guiding channel is uniform along a direction of guidance of the circuit board.

* * * * *